United States Patent [19]

Nakajima et al.

[11] 4,242,163

[45] Dec. 30, 1980

[54] PROCESS FOR MANUFACTURING MAGNESIUM CARBONATE BOARD

[75] Inventors: Shiro Nakajima; Toshiro Miyata, both of Aichi, Japan

[73] Assignee: Nippon Hardboard Co., Ltd., Nagoya, Japan

[21] Appl. No.: 962,918

[22] Filed: Nov. 22, 1978

Related U.S. Application Data

[63] Continuation of Ser. No. 811,280, Jun. 29, 1977, abandoned.

[30] Foreign Application Priority Data

Jun. 30, 1976 [JP] Japan ..... 51/078024

[51] Int. Cl.[3] ..... B29J 5/04

[52] U.S. Cl. ..... 156/242; 106/121; 156/246

[58] Field of Search ..... 156/89, 242, 244.11, 156/246; 106/58, 121

[56] References Cited

FOREIGN PATENT DOCUMENTS 109309 12/1939 Australia ..... 106/121

*Primary Examiner*—Caleb Weston

*Attorney, Agent, or Firm*—Cooper, Dunham, Clark, Griffin & Moran

[57] ABSTRACT

Magnesium carbonate board is prepared by mixing a neutral magnesium carbonate suspension with a fibrous material and the like, adding active magnesium, casting the resulting mixed suspension onto a porous, permeable carrier to form a layer thereon, laminating a number of said layers if desired and pressing and then heat curing the resulting platelike body.

1 Claim, 3 Drawing Figures

PROCESS FOR MANUFACTURING MAGNESIUM CARBONATE BOARD

This is a continuation of application Ser. No. 811,280 filed June 29, 1977, abandoned.

BACKGROUND OF THE INVENTION

1. Field of the Invention:

The invention relates to a process for manufacturing a magnesium carbonate board. More particularly, the invention relates to a process for manufacturing a magnesium carbonate board which is useful as building material.

2. Description of the Prior Art:

Hitherto the process for manufacturing a magnesium carbonate board consisted of preparing a neutral magnesium carbonate aqueous suspension by blowing gaseous carbon dioxide into an aqueous suspension of magnesium hydroxide, mixing the resulting neutral magnesium carbonate aqueous suspension with fibrous material and the like, casting the resulting mixed suspension onto a porous carrier to form a layer thereon through dehydration, laminating a number of said layers and pressing and heat curing the laminating layers. In such a process, a part of the neutral magnesium carbonate is changed into the bosic magnesium carbonate during the curing operation and gaseous carbon dioxide is formed. Formation of gaseous carbon dioxide makes a magnesium carbonate which is very porous. Conventional magnesium carbonate board has a specific gravity, below 0.85 low hardness and low flexural rigidity.

SUMMARY OF THE INVENTION

Accordingly, an object of the present invention is to provide a magnesium carbonate board having a high hardness and a high structural strength.

Another object of the present invention is to provide an efficient method for producing a magnesium carbonate board having a high hardness and a high structural strength.

Briefly, these objects of the present invention can be attained by a process which comprises mixing neutral magnesium carbonate suspension with a fibrous material as the main components, adding active magnesia, casting the resulting onto a porous carrier to form a layer through dehydration, laminating a number of said layers if desired and pressing and then heating the laminated layers to mold a plate-like body.

DETAILED DESCRIPTION OF THE PREFERRED EMBODIMENTS

Figure 1:
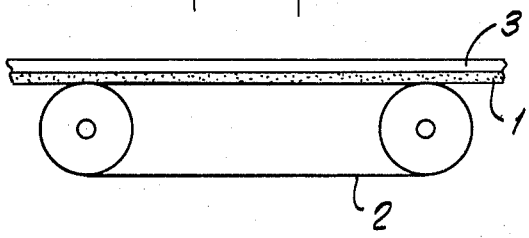
FIG. 1 is a side elevational view of a suction box attached with a caterpillar used in the process of the present invention.

A process for manufacturing a magnesium carbonate board according to the present invention comprises mixing a neutral magnesium carbonate aqueous suspension with a fibrous material, adding an active magnesia, casting the resulting mixed suspension onto a porous carrier to form a layer thereon by dehydration, producing and laminating a number of said layers if desired and pressing the resulting plate-like body and then heat curing. The present invention will be explained in detail as to the sequence of the unit processes, as follows.

A neutral magnesium carbonate aqueous suspension is mixed with fibrous material. Suitable neutral magnesium carbonate is generally prepared either by blowing gaseous carbon dioxide or a gas containing carbon dioxide into a magnesium hydroxide aqueous suspension or by double decomposition reaction between a magnesium salt, such as magnesium chloride, etc., and a carbonate, such as sodium carbonate, etc. It is desirable to use the desulfurized exhaust gas from a boiler using heavy oil as fuel as the carbon dioxide containing gas since such exhaust gas is cleaned at the same time carbon dioxide is removed. Suitable fibrous materials which are added and mixed with the suspension include vegetable fibers, such as wood pulp, cotton, hemp, etc.; animal fibers, such as wool silk and the like; mineral fibers, such as asbestos, glass filament, ceramic filament, rock wool and the like; and filaments of synthetic materials, such as polyester fibers, nylon fibers, acrylic fibers, polyethylene fibers, polypropylene fibers, polyvinylchloride fibers, polyvinylidene fibers, polyurethane fibers and the like. These fibers entangle mutually in the inner structure of the magnesium carbonate board and increase the structural strength thereof. Then or at the same time, an active magnesia is added to the suspension. An active magnesia is produced by firing of magnesium compound, such as magnesite slag, magnesium hydroxide, magnesium carbonate and the like at comparatively low temperature about 1000 C. Active magnesia having an activity of More than 0.01 moles is desirable. Activity of active magnesia is indicated by moles of iodine which is adsorbed into 1 mole of magnesium oxide. Active magnesia having an activity of greater than 0.01 moles has a notable ability to trap carbon dioxide. Generally, 5 to 40 weight part of active magnesia is added to 100 weight part of a neutral magnesium cabonate.

In addition to the above-mentioned components, other materials can be added to the suspension. Such other materials include, for example, calcium compounds, such as calcium sulfate, calcium sulfite and the like; silicon compounds, such as water glass and the like; mineral materials, such as alumina, cement, clay and the like; synthetic resins, such as synthetic rubber latices, polyvinylchloride emulsions, polyacrylamide, polyvinyl alcohol, polyethyleneimine and the like; water-repellent agents and the like. Other materials too numerous to mention are also suitable. The addition of alkaline metal compounds and/or alkali earth metal compounds such as salt of beryllium, magnesium, calcium, strontium, barium, lithium, sodium, potassium, rubidium, cesium to the suspension is desirable from the point of view of structure strength of the product. Above mentioned salts is combined with an active magnesia and reinforce the product. Calcium sulfite and the like by-products produced by desulfurizing sulfur-containing combustion exhaust gas are preferred as the calcium salts. Thus, magnesium carbonate obtained from the carbon dioxide of exhaust gas from a boiler and calcium sulfite obtained from desulfurizing the exhaust gas are especially useful as the raw materials for the production of the magnesium carbonate board in accordance with this invention. The solids concentration of the mixed suspension is regulated within about 10% by weight.

In the practice of this invention the mixed suspension is cast onto a porous carrier. The viscosity of the mixed suspension is usually low since the mixed suspension contains no basic magnesium carbonate. Therefore, a conventional metal wire net having comparatively large mesh as the porous, permeable carrier is not satisfactory due to leakage of the mixed suspension therethrough. To overcome this difficulty, a less porous carrier is used. The porous carrier used in the subject invention may be, for example, a non-woven textile; a knitted fabric; a plastic foam having continuous holes, such as polyurethane foam, polyethylene foam, polystyrene foam, and the like; sintered metal; porous ceramic and the like. In the case where fabrics or plastic foams or the like are used as porous materials, these carriers are reinforced with a back lining of a metal wire mesh or the like. The mixed suspension is cast on the porous carrier by suitable means, such as, for example, a flow box or weir, a roll coater, a knife coater, etc. It is desirable that the amount of said mixed suspension cast on the porous carrier is up to 1500 g solids per square meter, preferably in the range 200 to 1000 g per square meter. If an amount more than 1500 g per square meter of solids is applied to form a layer, the formed layer is apt to be uneven and the adhesive strength between the formed layers is decreased. A layer so formed on the porous carrier tends not to leak or lose water as filtrate therethrough. It is desirable, therefore, to apply a vacuum apparatus to remove the water. As the vacuum apparatus, a suction box connected to a vacuum pump, such as an oil diffusion pump, an ejector, etc., is useful.

Figure 2:
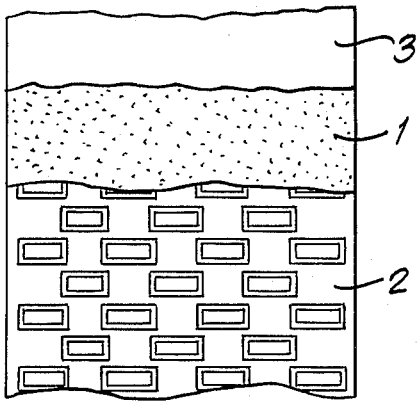
FIG. 2 is a partial plan, broken-away view of the above said suction box.
Figure 3:
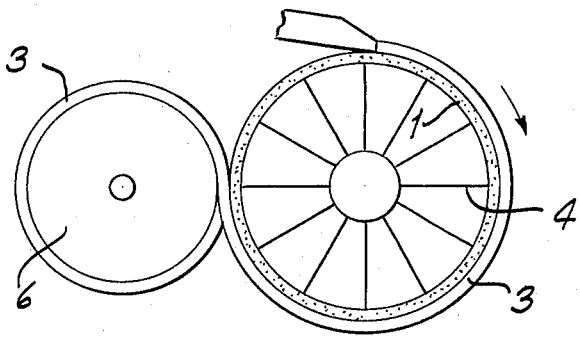
FIG. 3 is a side or longitudinal section of a vacuum filter employed in the process of the present invention.

With reference to FIGS. 1 and 2, a suction box provided with a foraminous caterpillar 2 in contact with and supporting porous carrier band 1 is useful wherein caterpillar 2 is operated in synchronism with the movement of carrier band 1. The mixed suspension may be cast, see FIG. 3, through feeder 5 onto porous carrier 1 which is fitted around vacuum filter 4 and wherein take-up roll 6 is shown in combination with filter 4 to receive and remove formed layer 3. It is generally desirable that the weight ratio of solids to water in layer 3 is within the range of 30:70 to 50:50 since in this range the layer shows good adherence with making roll 6 and in the heat curing less cracking occurs. The continuous process of layer making is carried out either by means of a moving, endless porous carrier, see FIGS. 1 and 2, or by, as shown in FIG. 3, a rotating vacuum filter.

A number of formed layers are then laminated if desired. Laminating can be carried out manually; however, in the case of the continuous operation, a making roll is utilized, that is, the layers which are made on the porous carrier, see FIGS. 1 and 2, or on the filter 4, see FIG. 3, are transferred to the making roll, such as roll 6 of FIG. 3. For example, after 1500 g per square meter solids of the mixed suspension is applied onto the carrier band 1, 10 such layers are laminated. After the desired number of layers are obtained, they are cut and removed from the making rolls.

For laminating, coating synthetic resin on the surface of the layer is desirable to improve the adherence between layers. Suitable synthetic resins which can be used for this purpose include urea resin, melamine resin, urethane resin, synthetic rubber, vinyl acetate resin, acryl resin, polyethylene, polypropylene, polyvinyl alcohol, polyethyleneimine, polyacrylic acid or its salts, polymethacrylic acid or its salts, polyvinylpyrrolidone, sodium alginate, carboxymethylcellulose and the like. Other resins, too numerous to mention, are also suitable. The abovementioned synthetic resins can be coated on the surface of the layer in a form of sol or emulsion, and by the usual coating methods, such as spraying, cascade, roll coating and brush coating. It is also useful to spread finely divided particulate material with or without said synthetic resins on the surface of the layer. Suitable such finely divided materials include mineral materials, such as diatomaceous earth, perlite, dicalite, celite, vermiculite, bentonite, fine sand, glass powder and the like; fine fibrous substances like glass fiber, nylon fiber, polyester fiber, acrylic fiber and the like; further plastic pieces, wood pieces, etc. The added finely divided material increases adherence between layers. It is desirable that the longitudinal diameter of the finely divided material be less than 1.5 mm.

The formed plate-like body is pressed either cold pressing or heat pressing is useful in the press molding operation. The pressure employed in the press molding operation is ordinarily less than about 70 kg per square centimeter. By the pressing operation, the thickness of the formed plate or board is controlled and adherence between layers is increased. The curing operation is desirably carried out in an environment providing more than about 80% relative humidity and at a temperature preferably in the range less than about 100°C. As a matter of course, the curing operation may be carried out in room temperature. During the curing operation, a part of the netural magnesium carbonate is changed into the basic magnesium carbonate and the pressed plate or board is hardened. And at the time carbon dioxide is formed and the active magnesia adsorbs instantly the formed geseous carbon dioxide to prevent that the gaseous carbon dioxide making the plate or board porous. Therefore the resulting plate or board has a high specific and a high structural strength. It is desirable to complete the curing operation within not less than 2 hours, more or less. After curing, the final or finished product is dried at less than 150° C.

EXAMPLE 1

A mixed suspension of the following composition is prepared:

Neural magnesium carbonate 5.1 parts by wt.
Asbestos 0.7 parts by wt.
Wood pulp 0.2 parts by wt.
Water 94.0 parts by wt.

Amounts of active magnesia added to the mixed suspension are shown in Table I.

TABLE I

| Sample No. | 1-1 | 1-2 | 1-3 | 1-4 |
|---|---|---|---|---|
| Active magnesia (wt %) | 3 | 6 | 12 | 24 |

An endless band composed of polyester fiber is used as the porous carrier. The suspension is cast onto one end of the rotating endless band or carrier. The amount of the suspension cast in the carrier is about 800 g solids per square meter as solids. The layer formed on the carrier is dehydrated by means of a suction box provided on the underside of the carrier and the suction box is regulated so that the water content of the applied layer is reduced to about 50% by weight. The layer is transferred to a making roll at the other end of the band and rolled up. When 18 segments of the layer so produced are laminated, they are cut and removed from the making roll. In this case, the thickness of the laminated layers is about 14.5 mm. the laminated layers are then cold pressed to a desired thickness with accompanying dehydration of the laminated layers to a plate-like body.

Various pressures in the range of 10 to 70 kg square centimete are employed. The plate-like body is then cured for 4 lhours at 95% relative humidity and a temperature of 80° C. and dried for 2 hours at a temperature of 130° C.

EXAMPLE 2

A suspension of the following composition is prepared:

Neutral magnesium carbonate 4.9 parts by wt.
Calcium sulfite 0.5 parts by wt.
Rock wool 0.4 parts by wt.
Wood pulp 0.2 parts by wt.
Water 94.0 parts by wt.
Amounts of active magnesia added to the mixed suspension are shown in Table 2

TABLE II

| Sample No. | 2-1 | 2-2 | 2-3 | 2-4 |
|---|---|---|---|---|
| Active magnesia (wt %) 3 | 6 | 12 | 24 | |

An Oliver filter provided with upper supply type rolled stainless sintered plate of the type illustrated in FIG. 3 is used as the porous carrier. The mixed suspension is cast on the Oliver filter at a rate of 700 g solids per square meter. The thus-formed layer on the Oliver filter is transferred to the making roll. When 20 layers so produced are laminated, the resulting laminate is cut. At this point, the water content rate of the laminate is 50% by weight and the thickness is 14.5 mm. The laminate is pressed by means of a cold press. Various pressures similar to Example 1 are employed. The resulting molded plate-like body is heat cured for 3.5 hours at 90% relative humidity and at a temperature of 120° C. After curing, the plate-like body is dried at 120° C. for 2.5 hours. The specific gravity and the bending strength of the resulting products produced in Example 1 and 2 are shown in Table III and IV

TABLE III

| | Specific gravity of the resulting products | | | |
|---|---|---|---|---|
| | Pressure of cold press (kg/sqcm) | | | |
| Sample No. | 10 | 30 | 50 | 70 |
| 1-1 | 0.78 | 0.80 | 0.88 | 0.90 |
| 1-2 | 0.80 | 0.88 | 0.90 | 0.95 |
| 1-3 | 0.85 | 0.90 | 0.95 | 1.10 |
| 1-4 | 0.85 | 0.98 | 1.00 | 1.10 |
| 2-1 | 0.82 | 0.85 | 0.88 | 0.91 |
| 2-2 | 0.84 | 0.87 | 0.91 | 0.94 |
| 2-3 | 0.90 | 0.94 | 0.97 | 1.10 |
| 2-4 | 0.95 | 0.99 | 1.06 | 1.15 |
| Contrast 1 | 0.60 | 0.75 | 0.85 | 0.87 |
| Contrast 2 | 0.61 | 0.78 | 0.85 | 0.85 |

Contrast 1, 2 are produced in the same manner of Example 1, 2 respectively without addition of an active magnesia.

TABLE IV

| | Bending strength of the resulting products (kg/sqcm) | | | |
|---|---|---|---|---|
| | Pressure of cold press (kg/sqcm) | | | |
| Sample No. | 10 | 30 | 50 | 70 |
| 1-1 | 80 | 120 | 138 | 151 |
| 1-2 | 85 | 140 | 156 | 178 |
| 1-3 | 103 | 145 | 173 | 195 |
| 1-4 | 105 | 150 | 175 | 198 |
| 2-1 | 82 | 135 | 145 | 152 |
| 2-2 | 85 | 145 | 159 | 185 |
| 2-3 | 105 | 150 | 178 | 195 |
| 2-4 | 110 | 155 | 180 | 198 |

TABLE IV-continued

| | Bending strength of the resulting products (kg/sqcm) | | | |
|---|---|---|---|---|
| | Pressure of cold press (kg/sqcm) | | | |
| Sample No. | 10 | 30 | 50 | 70 |
| Contrast 1 | 65 | 85 | 110 | 120 |
| Contrast 2 | 65 | 90 | 120 | 135 |

As indicated in Table III and IV, the products which contain active magnesia show higher specific gravity and higher bending strength. It is clear in Table III and IV that specific gravity and bending strength of the products is increased in proportion to the amount of active magnesia.

EXAMPLE 3

A suspension of the following composition is prepared:

Neutral magnesium carbonate 3.9 parts by wt.
Asbestos 0.4 parts by wt.
Wood pulp 0.25 parts by wt.
Water 95.0 parts by wt.
Amounts of active magnesia and magnesium sulfate added to the mixed suspension are shown in Table V

TABLE V

| Sample No. | 3-1 | 3-2 | 3-3 |
|---|---|---|---|
| Active magnesia (wt %) | 0.41 | 0.35 | 0.30 |
| Magnesium sulfate (wt %) | 0.04 | 0.10 | 0.15 |

The products were produced in the same manner of Example 1. The specific gravity and the bending strength of the resulting products produced in Example 3 are shown in Table VI and VII

TABLE VI

| | Specific gravity of the resulting products. | |
|---|---|---|
| | Pressure of cold press (kg/sqcm) | |
| Sample No. | 10 | 50 |
| 3-1 | 0.91 | 0.96 |
| 3-2 | 0.93 | 0.98 |
| 3-3 | 0.99 | 1.03 |
| Contrast 3 | 0.61 | 0.85 |

Constrast 3 is produced in the same manner of Example 3 without addition of an active carbon and magnesium sulfate.

TABLE VII

| | Bending strength of the resulting products.(kg/sqcm) | |
|---|---|---|
| | Pressure of cold press (kg/sqcm) | |
| Sample No. | 10 | 50 |
| 3-1 | 135 | 184 |
| 3-2 | 143 | 190 |
| 3-3 | 150 | 197 |
| Contrast 3 | 62 | 105 |

As indicated in Table VI and VII, specific gravity and bending strength of the resulting products are increased by addition of active magnesia and magnesium sulfate.

We claim:

1. A method of fabricating magnesium carbonate board or plate-like body which comprises forming an aqueous suspension comprising neutral magnesium carbonate admixed with fibrous material and active magnesia, casting the resulting formed aqueous suspension onto a porous permeable carrier to form a layer of solids thereon comprising said neutral magnesium carbonate, fibrous material and active magnesia, the amount of aqueous suspension cast onto said carrier being such as to deposit on said carrier an amount of solids comprising said neutral magnesium carbonate, active magnesia and fibrous material up to about 1500 grams of solids per square meter of said carrier onto which said suspension has been cast, the water content of said layer being controlled to a value in the range 30–50% by weight of said layer, laminating or building up a number of said layers comprising magnesium carbonate, active magnesia and fibrous material and pressing and heat curing the resulting laminated layers at a temperature less than about 100° C. and in an atmosphere having a relative humidity greater than 80% to form said magnesium carbonate board of plate-like body having a relatively high specific gravity in the range 0.78–1.15.

* * * * *

UNITED STATES PATENT AND TRADEMARK OFFICE

CERTIFICATE OF CORRECTION

PATENT NO. : 4,242,163

DATED : December 30, 1980

INVENTOR(S) : SHIRO NAKAJIMA & TOSHIRO MIYATA

It is certified that error appears in the above-identified patent and that said Letters Patent are hereby corrected as shown below:

COLUMN 1, line 29, after "carbonate" insert -- board --

COLUMN 4, line 28, after "the" insert -- same -- line 30, "geseous" should read -- gaseous --

COLUMN 5, line 1, after "kg" insert -- per --

COLUMN 5, under Table II, "3" should be under the second column, "6" should be under the third column, "12" should be under the fourth column and "24" should be under fifth column COLUMN 6, line 46, "Constrast" should read -- Contrast --

Signed and Sealed this

*Twenty-eighth* Day of *April 1981*

[SEAL]

*Attest:*

RENE D. TEGTMEYER

*Attesting Officer*

*Acting Commissioner of Patents and Trademarks*